US010456897B2

(12) United States Patent
Grandjean et al.

(10) Patent No.: US 10,456,897 B2
(45) Date of Patent: Oct. 29, 2019

(54) METHOD FOR CONTROLLING THE ACTUATION OF A GAS-POWERED FIXING TOOL AND THE CORRESPONDING DEVICE

(71) Applicant: Illinois Tool Works Inc., Glenview, IL (US)

(72) Inventors: Pascale Grandjean, Guilherand-Granges (FR); Pierre Cordeiro, Livron sur Drome (FR); Patrick Herelier, Saint Jean de Muzols (FR); Frederic Nayrac, Bourg les Valence (FR); Alain Vettoretti, Bourg les Valence (FR)

(73) Assignee: Illinois Tool Works Inc., Glenview, IL (US)

( * ) Notice: Subject to any disclaimer, the term of this patent is extended or adjusted under 35 U.S.C. 154(b) by 280 days.

(21) Appl. No.: 15/378,840

(22) Filed: Dec. 14, 2016

(65) Prior Publication Data

US 2017/0173771 A1 Jun. 22, 2017

(30) Foreign Application Priority Data

Dec. 18, 2015 (FR) ..... 15 62728

(51) Int. Cl.
*B25C 1/08* (2006.01)
*B25F 5/00* (2006.01)

(52) U.S. Cl.
CPC . *B25C 1/08* (2013.01); *B25F 5/00* (2013.01)

(58) Field of Classification Search
CPC ..... B25C 1/08; B25F 5/00
USPC ..... 227/2, 4, 9, 10, 11; 123/46 SC
See application file for complete search history.

(56) References Cited

U.S. PATENT DOCUMENTS 5,133,329 A * 7/1992 Rodseth ..... B25C 1/08 123/46 SC
6,123,241 A * 9/2000 Walter ..... B25C 1/08 123/46 SC
6,722,550 B1 * 4/2004 Ricordi ..... B25C 1/08 123/46 SC (Continued)

FOREIGN PATENT DOCUMENTS

EP 1 391 270 2/2004
EP 1 782 925 5/2007

(Continued)

*Primary Examiner* — Nathaniel C Chukwurah
(74) *Attorney, Agent, or Firm* — Neal, Gerber & Eisenberg LLP

(57) ABSTRACT

The present disclosure concerns a method and an electronic ignition control device of a combustion chamber of a gas-powered fixing tool designed to optimize the quality of the shooting of fixation elements by the tool. According to the principle of the present disclosure, the triggering of the ignition of the chamber to produce the shot is commanded on the condition that the time between the moment when the user places the tool against a work surface and the moment when he pulls on an actuation trigger of the tool is greater than a predefined delay time, to ensure an optimal filling of the combustion chamber with the combustible gas. According to one embodiment of the present disclosure, the triggering of the ignition is enabled on the supplemental condition that a signal of medium ignition voltage is greater than a trigger threshold voltage.

20 Claims, 8 Drawing Sheets

(56) References Cited

U.S. PATENT DOCUMENTS

| | | | | |
|---|---|---|---|---|
| 7,284,511 | B2 * | 10/2007 | Zahner | B25C 1/08 123/46 H |
| 2003/0218042 | A1 * | 11/2003 | Odoni | B25C 1/08 227/10 |
| 2008/0223895 | A1 * | 9/2008 | Fujisawa | B25C 1/08 227/2 |
| 2010/0243699 | A1 * | 9/2010 | Largo | B25C 1/08 227/2 |

FOREIGN PATENT DOCUMENTS

| | | |
|---|---|---|
| EP | 1 878 540 | 1/2008 |
| WO | WO 2008/048294 | 4/2008 |

* cited by examiner

METHOD FOR CONTROLLING THE ACTUATION OF A GAS-POWERED FIXING TOOL AND THE CORRESPONDING DEVICE

PRIORITY CLAIM

This patent application claims priority to and the benefit of French Patent Application No. 1562728, which was filed on Dec. 18, 2015, the entire contents of which are incorporated herein by reference.

FIELD

The present disclosure lies in the field of portable tools for the fixation of parts by way of nails or staples propelled by a driving piston, under the effect of the combustion of a gas.

More specifically, the present disclosure involves a method and a device for controlling the actuation of such a tool to trigger the firing of a fixation element (nail, staple).

BACKGROUND

As is known, a gas-powered fixing tool comprises, in a housing, an internal combustion engine for propulsion of a piston driving a fixation element such as a nail or a staple, designed to be anchored in a material composing a work surface. The engine comprises at least one internal combustion chamber adapted to contain a mixture of air and combustible gas whose igniting by an internal ignition device causes the propelling of a piston designed to drive the fixation element at the exit of a guide tip, extending in front of the housing. The supplying of combustible gas to the combustion chamber is done by means of an injection element from a gas cartridge. Such a tool likewise comprises an actuation trigger designed to command the triggering of the shot to propel a fixation element by means of the piston. The activation of this trigger by a user results in the generating of an electric arc in the combustion chamber by means of the ignition device.

This kind of tool can produce shots of poor quality, characterized by a partial embedding of the nail or the staple in the material after the activation of the actuation trigger of the tool by a user.

As is known, the mechanical bearing of the tool against a work surface triggers a process of preparation, at the end of which the tool is "ready to shoot". This process of preparation comprises the following steps: percussion of the cartridge of combustible gas, filling of the combustion chamber by displacement of the gas from the cartridge, at the same time producing a purging of the chamber.

The pulling on the trigger during the preparation process has the effect of interrupting the filling of the combustion chamber by closing of the chamber. In event of interruption of the process, the filling of the chamber and its purging are partial, so that the tool is not in optimal firing conditions. If the user is too quick in the sequence of bearing with the tool and activation of the trigger of the tool, a shot of poor quality will be triggered. Consequently, there is a need to guarantee optimal firing conditions enabling a reliable embedding of the fixation element in the work zone.

SUMMARY

In order to remedy the aforementioned drawbacks of the prior art, the present disclosure proposes a method and an electronic ignition control device for an internal combustion chamber of a gas-powered fixing tool, whereby the shot is triggered upon activation of the trigger, provided that the time of filling of the combustion chamber is optimal. For this, a mechanism makes it possible to prevent the triggering of the shot if a time condition is not fulfilled. This condition involves the time elapsing between the detection of a first mechanical event triggering the filling of the chamber with the gas, for example the bearing with the tool against the work surface, and a second mechanical event corresponding to pulling on the trigger, indicating the desire of the user to trigger the shot.

The method according to the present disclosure involves the following steps:

- detection of a first mechanical event at a first instant;
- detection of a second mechanical event at a second instant;
- generation of a control signal for triggering the ignition of the combustion chamber following the detection of the second mechanical event, if the time between the first and second mechanical events is greater than a first predetermined threshold.

Advantageously, the triggering of the ignition of the combustion chamber can only occur if the time for the filling of the combustion chamber between the first instant and the second instant is greater than a first predetermined threshold corresponding to an optimal filling time for the combustion chamber.

In the event that a user is too quick with the sequence of the bearing of the tool (first mechanical event) and the activation of the trigger of the tool (second mechanical event) to trigger the firing, without observing a minimum time corresponding to the first threshold, the triggering of the ignition of the combustion chamber is not allowed. In fact, if the time measured between the moment when the user bears with the tool against the work surface and the moment when he pulls on the trigger of the tool is too short, the combustion chamber will not have enough time to become sufficiently filled with combustible gas to produce a quality shot.

According to one particular embodiment of the present disclosure, the step of generation of the control signal comprises the following substeps:

- time measurement to measure the elapsed time between the first instant and the second instant;
- time comparison to compare the elapsed time and the first predetermined threshold; and
- generation of said signal if said elapsed time is greater than the first threshold.

By preventing the triggering of the ignition of the chamber in the case when the time measured between the first and second instants is less than the first threshold, one thus avoids shots of poor quality, characterized by a partial embedding of the nail due to a lack of power. In this way, it is guaranteed that at the time of activation of the trigger the combustion chamber is sufficiently full to generate a sufficient power of explosion or combustion to ensure a good quality of shot. According to another embodiment of the present disclosure, the step of generation of the control signal comprises the following substeps:

- triggering of a timeout of a time equal to said threshold upon the detection of the first mechanical event; and
- generation of said control signal if the detection of the second event occurs after the timer times out.

Advantageously, the shot is enabled only if the time delay has totally elapsed, to allow a sufficient filling of the combustion chamber to guarantee a shot of good quality at the moment when the user pulls on the trigger (second mechanical event).

According to one embodiment of the present disclosure, the step of generation of the ignition triggering control is performed only on the additional condition that the time between the first and second mechanical events is less than a second predetermined threshold.

The second predetermined threshold corresponds to a maximum filling time beyond which the firing conditions are no longer optimal. Thus, if the user pulls too late on the trigger after the bearing with the tool (first mechanical event), the control signal for triggering will not be generated in order to prevent a shot of poor quality. In fact, beyond a certain filling time, the conditions of the combustion gas mixture in the chamber are no longer optimal.

According to one embodiment of the present disclosure, the shot is allowed if the effective filling time of the combustion chamber corresponding to the time between the first and second instants lies within a confidence interval whose lower and upper limits correspond respectively to the first and second thresholds, this confidence interval being determined to guarantee optimal firing conditions.

The method further comprises an adjustment step to adjust at least one of the thresholds as a function of at least one temperature parameter.

As a nonlimiting example, the temperature parameter can be selected from among any of the following parameters: ambient temperature or working temperature, temperature in the vicinity of the combustion chamber, temperature inside the combustion chamber, or temperature in the vicinity of another zone of the tool, such as an optional evaporator.

The value of the delay time for which the firing conditions are optimal depends on at least one of the above temperature parameters. Thus, the taking account of at least one temperature parameter advantageously allows for a more accurate adjusting of the value of the delay time and thus a further improving of the quality of the shot.

According to one embodiment, only the first threshold is adjusted during the adjustment step, while according to another embodiment the first and second thresholds are adjusted during the adjustment step.

The method can further comprise:

- a step of generation of a medium ignition voltage initiated as soon as the first mechanical event is detected at the first instant;
- a step of voltage comparison to compare the medium ignition voltage relative to a reference trigger voltage.

In this case, the trigger control is generated on the additional condition that the medium ignition voltage has an amplitude greater than the reference trigger voltage.

The fact of beginning to generate the medium ignition voltage signal as of the detection of the first mechanical event at the first instant makes it possible to obtain a shot in immediate fashion when the user pulls on the trigger, provided that the medium ignition voltage signal has reached the threshold value for the triggering. This characteristic is particularly advantageous in comparison with the known solutions of the prior art for which the medium ignition voltage is generated only after the user has pulled on the trigger. For example, the bearing with the tool against a work surface instantaneously causes the start of the generating of the medium voltage ignition signal without waiting for the activation of the trigger.

The method may further comprise, between the step of medium ignition voltage generation and the step of voltage comparison of the medium ignition voltage signal, a step of conversion of said medium ignition voltage signal.

Another advantage of the present disclosure lies in the precision of the measurement of the medium ignition voltage due to the conversion step. The improved measurement precision achieved makes it possible to guarantee constant energy in the spark produced, regardless of the ignition device in question.

Advantageously, the conversion step makes it possible to convert the medium voltage analogue signal into a digital value which can be processed during the conversion step.

According to one embodiment, the step of generation of the medium ignition voltage is initiated (for example, by the charge of a capacitor), before the step of detection of the second mechanical event at the second instant (for example, before the user pulls on the trigger).

The present disclosure likewise involves a device for controlling electronic ignition of an internal combustion chamber of a gas-powered fixing tool, characterized in that it comprises:

- first detection means to detect a first mechanical event at a first instant;
- second detection means to detect a second mechanical event at a second instant;
- means for generating a control signal for triggering the ignition of the combustion chamber following the detection of the second mechanical event, if the time between the first and second mechanical events is greater than a first predetermined threshold.

According to one particular embodiment of the present disclosure, the means for generating the control signal comprise:

- time measurement means suitable for measuring the elapsed time between the first instant and the second instant;
- time comparison means to compare the elapsed time and the first predetermined threshold; and
- control generation means to generate the control signal if said elapsed time is greater than the first threshold.

According to one embodiment of the present disclosure, the first detection means comprise a release switch driven by the second event (activation of a trigger of the tool), the second detection means comprise a push switch driven by the first event (bearing with the tool against a work surface), the release switch and the push switch being linked to the time measurement means.

According to another particular embodiment of the present disclosure, the means for generating the control signal comprise timer means of a time equal to the first threshold, the timer means being suitable for triggering the timer upon the detection of the first mechanical event and the generation means are suitable for generating the control signal after the timer times out.

According to one embodiment of the present disclosure, the first detection means comprise a release switch driven by the activation of a trigger of the tool (second mechanical event), the second detection means comprise a push switch driven by a bearing with the tool against a work surface (first mechanical event), the timer means comprise a timer module coupled to a timer switch mounted in series between the release switch and the push switch.

According to one embodiment of the present disclosure, the means for generating the control signal are suitable for generating the control signal on the additional condition that the time between the first and second mechanical events is less than a second predetermined threshold.

According to another embodiment of the present disclosure, the device further comprises adjustment means for adjusting at least one of said thresholds as a function of at least one temperature parameter.

According to another embodiment of the present disclosure, the device further comprises:

means for generating a medium ignition voltage suitable for generating the medium voltage, as soon as the first mechanical event is detected at the first instant;

voltage comparison means to compare the medium ignition voltage relative to a reference trigger voltage, In this case, the means for generating the trigger control are suitable for generating said control if the amplitude of the medium ignition voltage signal is greater than the reference trigger voltage.

According to another embodiment of the present disclosure, the device further comprises voltage conversion means to convert the medium ignition voltage into a voltage comparable to the reference trigger voltage.

According to one embodiment, the means of generation of a medium ignition voltage are adapted to generate said medium ignition voltage before the second means of detection detect the second mechanical event at the second instant.

Advantageously, the device is arranged in a removable block.

The integration of the ignition control device in the same removable block enables a maintenance and easy replacement of this block, during repair or servicing operations.

The present disclosure likewise concerns a gas-powered fixing tool comprising an electronic ignition device according to the characteristics described above.

BRIEF DESCRIPTION OF THE DRAWINGS

Other characteristics and advantages of the present disclosure will emerge from the following description, with reference to the drawings which illustrate an exemplary embodiment thereof, lacking any limiting nature.

DETAILED DESCRIPTION

Figure 1:
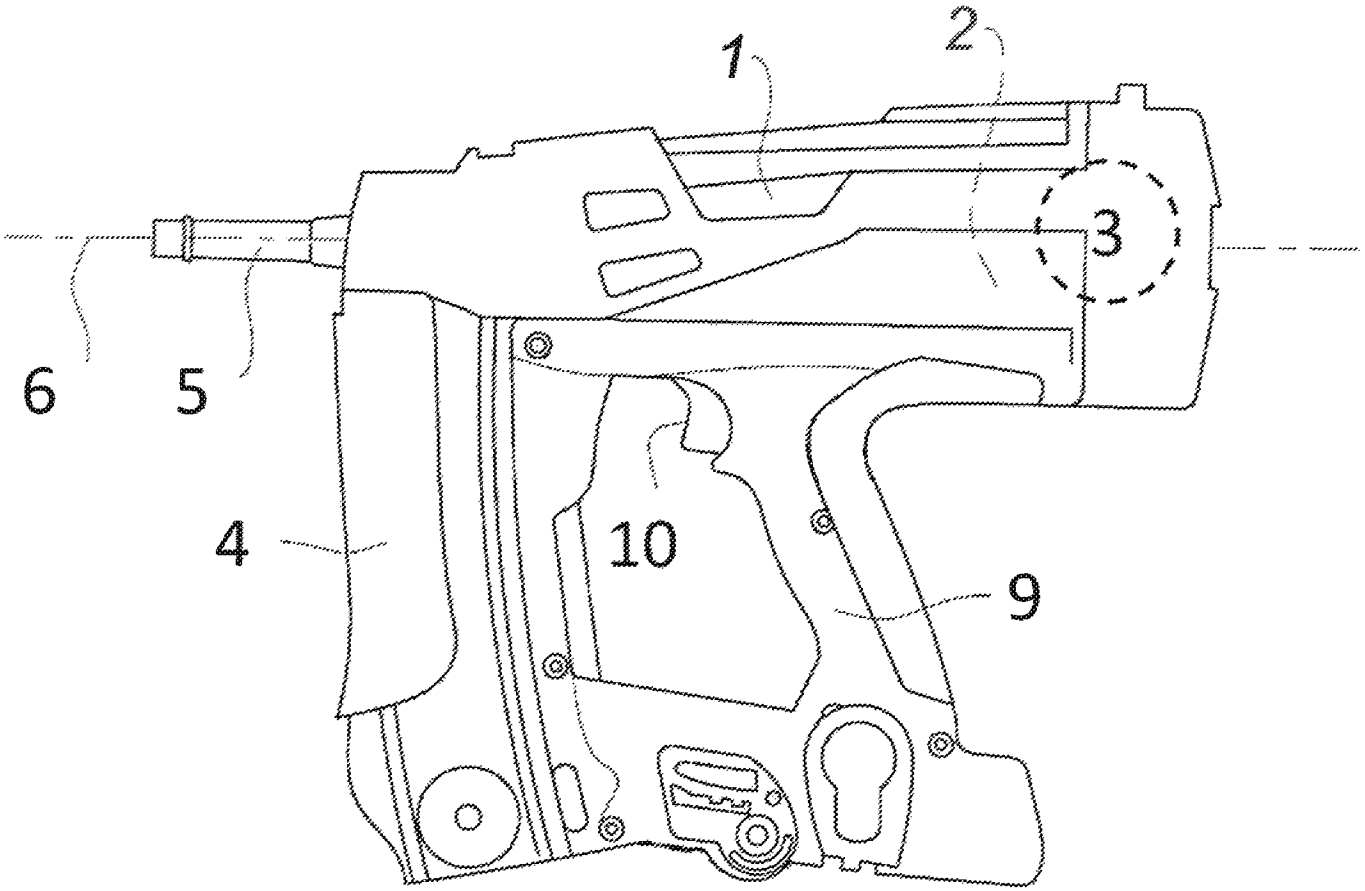
Fig. 1 PRIOR ART
FIG. 1 illustrates schematically a gas-powered fixing tool according to the prior art.

FIG. 1 describes, in accordance with the prior art, a gas-powered fixing tool, such as a nail gun, comprising a housing 1 in which is located an internal combustion engine 2 with a combustion chamber 3 adapted to contain a mixture of air and combustible gas, whose firing causes the propulsion of a piston adapted to drive a fixation element such as a nail or a staple taken from a feeding magazine 4, the fixation element being designed to become anchored in a support material at the exit from a guide tip 5 extending in front of the housing 1. The housing of the tool has an axis 6 along which move the driving piston and, in the guide tip 5, the fixation elements.

The supplying of combustible gas to the combustion chamber 3 is done by means of an injection element, such as a mechanical or electrical one (like an electric valve) from a cartridge of combustible gas. The gas cartridge can be connected to a first precombustion chamber, followed by the combustion chamber, the latter being in communication with the piston designed to propel the nails emerging from the guide tip.

Such a tool likewise comprises a handle 9 for grasping and handling and shooting, on which is mounted a trigger 10 for actuating the tool, designed to command the triggering of the shot.

This tool further comprises an electronic ignition device to ignite the combustion chamber 3 when the trigger 10 of the tool is actuated by a user.

Figure 2:
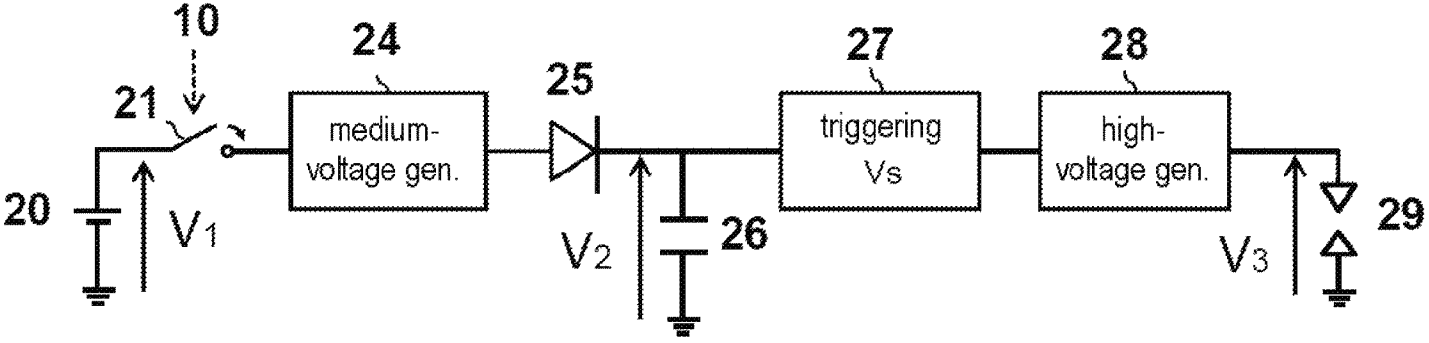
Fig. 2 PRIOR ART
FIG. 2 illustrates an ignition device of the combustion chamber of a gas-powered fixing tool according to the prior art.

As illustrated in FIG. 2, the electronic ignition device according to the prior art comprises a source of low voltage energy 20 adapted to provide an electrical signal of low voltage $V_1$, a medium ignition voltage generator 24 adapted to provide an electric signal of medium ignition voltage $V_2$, a high-voltage spark generator 28 adapted to provide an electric signal of high spark voltage $V_3$ and a spark plug 29 adapted to provide an electric arc in the combustion chamber to initiate the combustion of the gas.

In the following, the term "high voltage" shall mean "high spark voltage" and the term "medium voltage" shall mean "medium ignition voltage".

The source of low-voltage energy 20 includes, for example, of a battery providing a d.c. voltage of 6 V. The generator of medium ignition voltage 24 is adapted to provide an electric signal of medium ignition voltage $V_2$ with an amplitude of the order of 250 V, from the electric signal of low voltage $V_1$. The generator of medium ignition voltage, built from MOS transistors, is associated with a diode-based transformer 25 and it provides the medium ignition voltage signal $V_2$ to the terminals of an energy storage capacitor 26. The high-voltage generator comprises a transformer having a primary winding and a secondary winding to generate a high-voltage signal $V_3$ at the terminals of the spark plug 29.

A switch 21 associated with the trigger 10 is mounted in series between the source of low-voltage energy 20 and the generator of medium ignition voltage 24, so that when the trigger 10 is actuated by the user the source of low-voltage energy energizes the generator of medium ignition voltage. Consequently, the actuating of this switch 21 causes the charging of the capacitor 26. When the voltage on the terminals of the capacitor reaches a predetermined threshold Vs, a trigger device 27 based on an electronic component primed by the voltage on its terminals suddenly discharges the capacitor 26 into the primary winding of the transformer of the high-voltage generator 28, creating in the secondary winding of this transformer an electric signal of high voltage $V_3$ with amplitude greater than 20 kV. There ensues the generation of a spark in the area of the spark plug 29, enabling the ignition of the combustion chamber 3.

This ignition mechanism has the following drawback. If the user is too quick in the sequence of bearing with the tool and activation of the trigger to trigger the firing, the ignition of the combustion chamber will occur while it is partially filled with gas, not affording a sufficient combustion power to ensure a shot of good quality, which will result in a partial embedding of the fixation elements in the work zone.

Figure 3:
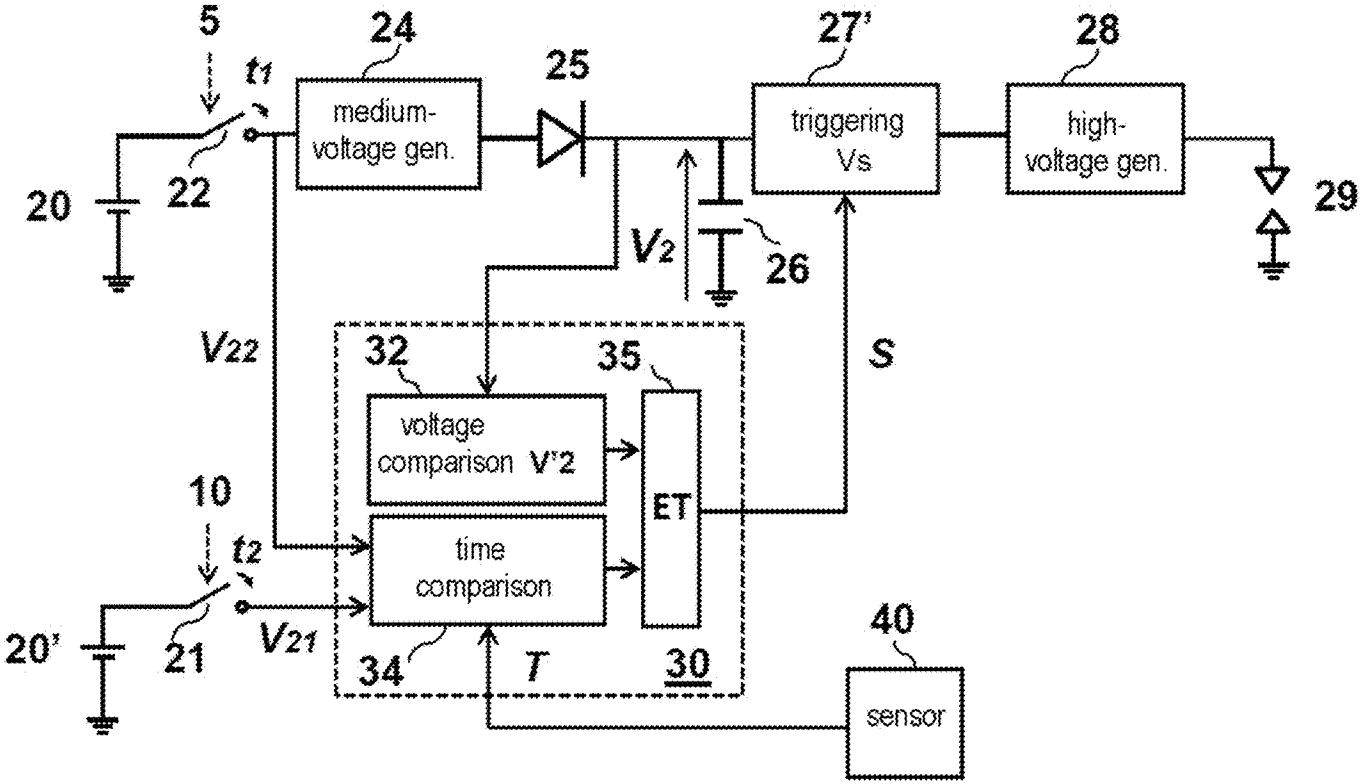
FIG. 3 illustrates an ignition device of the combustion chamber of a gas-powered fixing tool comprising the electronic ignition control device according to a first embodiment of the present disclosure.

In order to guarantee optimal combustion conditions, the ignition device known from the prior art is adapted to receive an electronic ignition control device for the combustion chamber of the tool according to the present disclosure, as illustrated in FIG. 3.

The ignition control device according to the present disclosure comprises a first switch 21 driven by the actuating of the trigger 10 (second mechanical event), a second switch 22 driven by the pushing of the guide tip 5 against a work surface (first mechanical event), and a microcontroller 30 designed to interface with the first and second switches.

The second switch 22 is mounted in series between the source of low-voltage energy 20 and the generator of medium ignition voltage 24, so that the generator of medium ignition voltage 24 is energized by the source of low-voltage energy 20 when the guide tip 5 is pushed against the work surface at a first instant $t_1$. The microcontroller 30 is designed to interface with the second switch to receive a signal $V_{22}$ as to the detection of the pushing of the tool at the first instant $t_1$ from which the microcontroller measures the time elapsed.

The first switch 21 is mounted in series with a source of low-voltage energy 20', so as to provide to the microcontroller a signal of detection $V_{21}$ of the actuation of the trigger when the trigger 10 is actuated by the user at a second instant $t_2$. The microcontroller 30 is designed to interface with the first switch 21, so as to receive the signal of detection of actuation $V_{21}$ at the second instant $t_2$.

The microcontroller 30 is designed to receive in real time a charge signal $V_2$ provided at the terminals of the capacitor 26, to convert this signal into a converted signal $V'_2$ and to compare the latter against a trigger threshold voltage $V_d$ (means of conversion and comparison 32).

The microcontroller 30 is adapted to measure a time $\Delta t$ between the first instant $t_1$ and the second instant $t_2$ and to compare this time to a reference timing value.

The microcontroller 30 is likewise adapted to provide a control signal S to a controlled trigger device 27' disposed between the generator of medium ignition voltage 24 and the generator of high voltage 28 (means of command generation 35).

Figure 4:
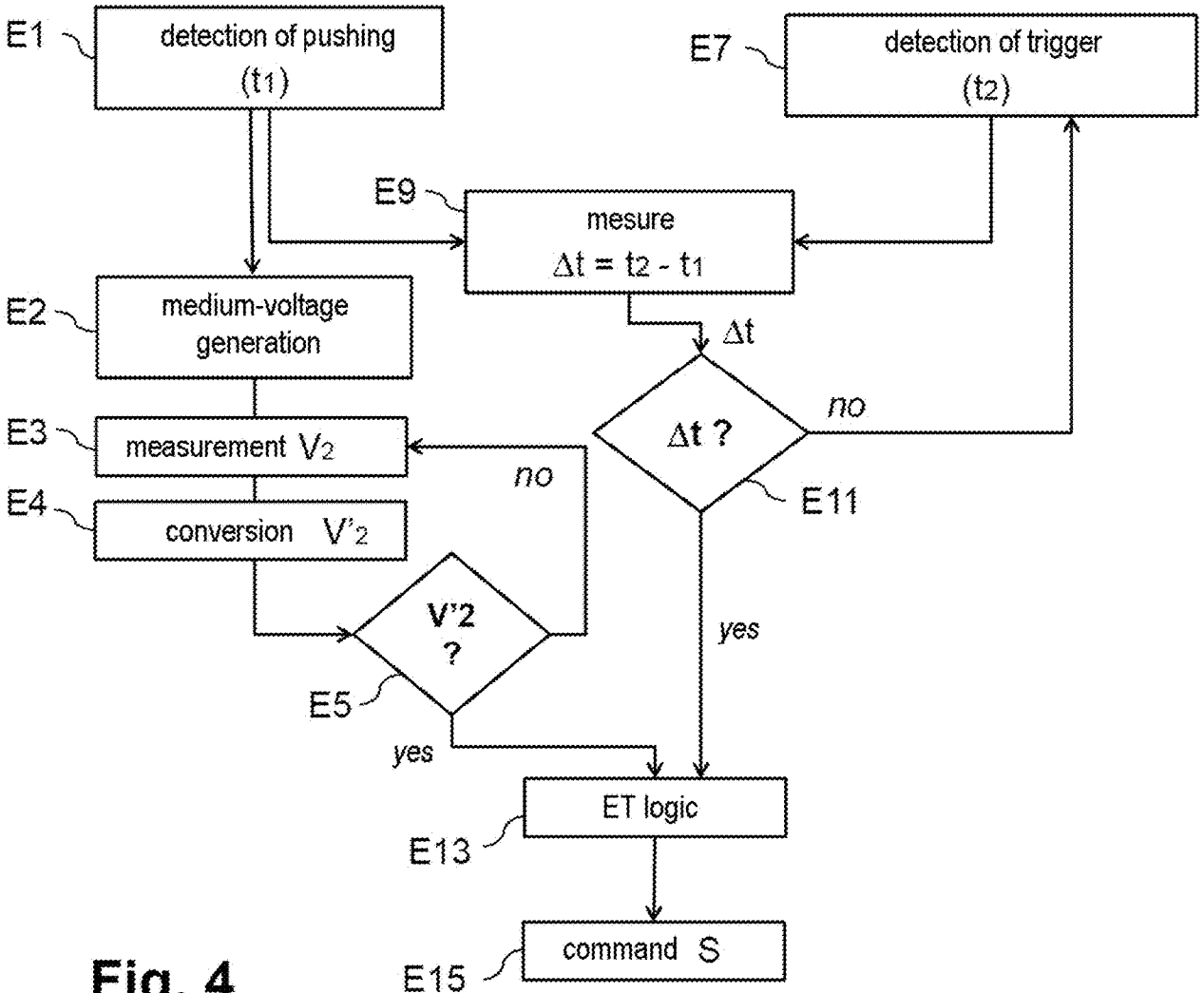
FIG. 4 illustrates the steps in the method of control of the ignition of the combustion chamber according to a first embodiment of the present disclosure.

The method of control of the electronic ignition of the combustion chamber 3 according to the present disclosure will now be described in reference to FIGS. 3 and 4. FIG. 4 illustrates the steps of the method of control of the ignition of the combustion chamber according to one embodiment of the present disclosure.

The pushing of the guide tip 5 of the tool against a work surface at a first instant $t_1$ constitutes an example of the first mechanical event which causes the percussion of the combustible gas cartridge and the displacement of this gas into the precombustion chamber and the combustion chamber 3, at the same time achieving the purging of these chambers. Thus, at this first instant $t_1$ there begins the filling and the purging of the combustion chamber by the gas. The mechanical pushing of the tool against the work surface has the effect of toggling the second switch 22 associated with the guide tip 5. This pushing is detected at the first instant $t_1$, during a first step of detection $E_1$, by the microcontroller 30 interfacing with the second switch. The microcontroller comprises a memory designed to record a first time value corresponding to the first instant $t_1$.

At this same first instant $t_1$, the toggling of the second switch 22 has the effect of electrically powering the generator of medium ignition voltage from the source of low-voltage energy. The electric signal of medium ignition voltage $V_2$ is generated during a step of generation of medium ignition voltage $E_2$, during which the capacitor 26 is charged.

Advantageously, the fact of starting the charging of the capacitor as of the instant when the tool is brought to bear against the work zone affords the possibility of precharging the capacitor before the user pulls on the trigger. This embodiment of the present disclosure prevents a delay between the instant when the trigger is activated and the moment when the medium ignition voltage is generated, given that the time needed to generate the medium ignition voltage is generally between 30 ms and 60 ms. In this way, a shot can be produced instantaneously as soon as the user pulls on the trigger, which is not the case with the gas fixing tools known from the prior art, for which the charging of the capacitor is initiated only after the pulling on the trigger, causing a delay of 30 to 60 ms.

According to one embodiment of the present disclosure, the microcontroller is adapted to measure the electric signal of medium ignition voltage $V_2$ during a voltage measurement step $E_3$.

The microcontroller is adapted to convert this measured signal into a converted signal $V'_2$ with amplitude comparable to the trigger threshold voltage $V_d$ during a conversion step $E_4$.

The microcontroller is adapted to compare the converted signal $V'_2$ in relation to a trigger threshold voltage $V_d$ during a voltage comparison step $E_5$. The exceeding of this threshold voltage is necessary but not sufficient to produce the triggering of the ignition of the combustion chamber.

At a second instant $t_2$, the user pulls on the trigger 10 for actuating the tool, indicating a desire on the part of the user to produce a firing. This second mechanical event has the effect of closing the combustion chamber and thus halting its filling with the gas. The pulling on the trigger causes a toggling of the first switch 21, this toggling being detected by the microcontroller 30, during a second detection step $E_7$. The microcontroller 30 is adapted to measure, at this same second instant $t_2$, the time elapsed since the first instant $t_1$. This measurement is done during a time measurement step $E_9$. This time $\Delta t = t_2 - t_1$ corresponds to the effective filling time $\Delta t$ of the combustion chamber with the gas, between the moment when the user has placed the tool mechanically bearing against the work surface and the moment when the user pulls on the actuation trigger in order to trigger the firing. During a time comparison step $E_{11}$, the time $\Delta t$ measured between the first instant $t_1$ and the second instant $t_2$, is compared to a first predetermined threshold $\Delta t_{R1}$ to guarantee optimal firing conditions. This first value $\Delta t_{R1}$ corresponds to the minimum gas filling time to obtain a necessary combustion power for a complete embedding of the fixation element in the work zone.

According to one embodiment of the present disclosure, the triggering of the ignition of the combustion chamber can only take place if the effective filling time $\Delta t$ is greater than the first threshold $\Delta t_{R1}$. Thus, one avoids too fast a pulling on the trigger and producing a shot of poor quality.

For example, if the action on the trigger was too soon by the user and did not leave time for the mixture of air and combustible gas to sufficiently fill the volume of the combustion chamber, the spark is not triggered, so as to avoid an explosion of poor quality producing an imperfect nailing and a needless damaging of the part being attached.

According to one particular mode, there also exists a second predetermined threshold $\Delta t_{R2}$, corresponding to a filling time for the combustion chamber beyond which the firing conditions are no longer optimal.

Thus, according to one particular embodiment of the present disclosure, the method involves a supplemental time comparison step during which one further tests whether the measured time $\Delta t$ exceeds the second threshold $\Delta t_{R2}$, in order to guarantee a shot of good quality.

When this supplemental condition is applied, the triggering of the shot can only take place if the measured time $\Delta t = t_2 - t_1$ is within a confidence interval whose lower and upper limits correspond respectively to the minimum and maximum timing values, such that: $\Delta t_{R1} \leq \Delta t \leq \Delta t_{R2}$.

The microcontroller 30 is adapted to memorize the value of the first threshold $\Delta t_{R1}$ (first value) and optionally the value of the second threshold $\Delta t_{R2}$ (second value), in which case the first and second values define the confidence interval guaranteeing optimal combustion conditions for a shot of good quality.

According to one embodiment of the present disclosure, the value of the first threshold $\Delta t_{R1}$ and/or of the second $\Delta t_{R2}$ threshold is adjusted during an adjustment step (not represented), as a function of at least one temperature parameter T such as the ambient temperature or working temperature, such as is provided by a temperature sensor 40.

According to one particular embodiment, the value of the first threshold is adjusted. According to another embodiment, the value of the second threshold is adjusted, alone or in combination with the adjustment of the value of the first threshold, so as to adjust the confidence interval as a function of fluctuations in the temperature T.

According to one embodiment of the present disclosure, this adjustment step is carried out by the microcontroller. The temperature sensor 40 is secured so as to measure in real time the ambient temperature or working temperature. In the event that the tool has an evaporator, the temperature sensor 40 can be attached to the evaporator, if heat transfers occur between the combustion chamber and the evaporator.

Such an adjustment advantageously allows one to take into account temperature conditions for producing an optimal combustion according to the physico-chemical properties of the gas used. For example, the value of the first threshold is set at 0.40 seconds and the value of the second threshold is set at 0.150 seconds when using butene/propene or a mixture of alkenes as the combustible gas, for an operating temperature between −10° C. and 50° C.

As long as the effective filling time $\Delta t$ of the combustion chamber is within the confidence interval (first condition) and the generator of medium ignition voltage is supplying to the terminals of the capacitor a voltage greater than the trigger threshold voltage $V_d$ (second condition), the triggering of the ignition is commanded by the microcontroller.

Thus, when the above two conditions are met at the end of a Boolean logic step $E_{13}$ (ET), the microcontroller provides, during a sending step $E_{15}$, a triggering control signal S to the controlled trigger device 27' to produce the ignition of the combustion chamber.

Advantageously, the shot is only triggered if the effective filling time of the combustion chamber lies within the confidence interval corresponding to an optimal filling of the combustion chamber with the combustible gas and the voltage at the terminals of the capacitor exceeds the trigger voltage threshold. In this way, it is guaranteed that, upon activation of the trigger by the user, the combustion chamber is sufficiently filled to generate a power necessary to ensure a good quality of shot.

The controlled trigger device 27' is a classical device based on electronic components primed by the voltage at its terminals ($V > V_d$). It is distinguished from the trigger device of the prior art 27 in that it is designed to be driven by the microcontroller so as to activate the generator of high voltage upon receiving the trigger control signal S.

According to the embodiment described above, the first and second conditions need to be fulfilled in order to allow the generation and the sending of the trigger command S for the shot. However, in other embodiments, only the first condition will need to be fulfilled in order to trigger the shot.

According to one variant embodiment, if the first or the second condition, or the first and the second conditions are not fulfilled at the moment when the user pulls on the trigger 10 in order to trigger the shot, the step of generation and sending $E_{15}$ of the command S is delayed while waiting for all of the conditions required to be fulfilled.

For example, assuming that the user is too quick in performing the sequence of the first and second mechanical events, corresponding respectively to the bearing with the tool against the work zone and the pulling on the trigger, so that the combustion chamber has not had time to be filled in optimal manner (see FIG. 5 "sequence B"), the pulling on the trigger does not produce an instant closing of the combustion chamber, so that it remains open for yet another supplemental time to complete the filling of the chamber. This supplemental time $\Delta t - \Delta t_{R\{1,2\}}$ corresponds to the difference between the effective filling time $\Delta t = t_2 - t_1$ and the first threshold $\Delta t_{R1}$ (or the second threshold $\Delta t_{R2}$ or any other value contained between the first and second thresholds).

The steps of the method according to the present disclosure, including the steps of detection $E_1$, $E_2$, of time measurement $E_3$ and comparison $E_{11}$, of generating $E_{15}$ a command, of voltage conversion $E_4$, of voltage measurement $E_3$ and comparison $E_5$, and of adjustment, as described above, are carried out by means of the microcontroller 30. The skilled person will understand that equivalent means to the microcontroller could be employed for the carrying out of these steps without leaving the scope of the present disclosure.

The present disclosure will now be described with reference to the chronogram of FIG. 5*a*, showing even further advantages. This chronogram illustrates the sequencing of different events and/or phases occurring during the use of the tool incorporating the control device according to the present disclosure:

- S1: mechanical bearing with the tool against the work surface;
- S2: activation of the second switch 22;
- S3: activation of the first switch 21;
- S4: preparation of the ignition, involving the generation of a medium ignition voltage; and
- S5: generation of the spark by the spark plug 29.

Figure 5:
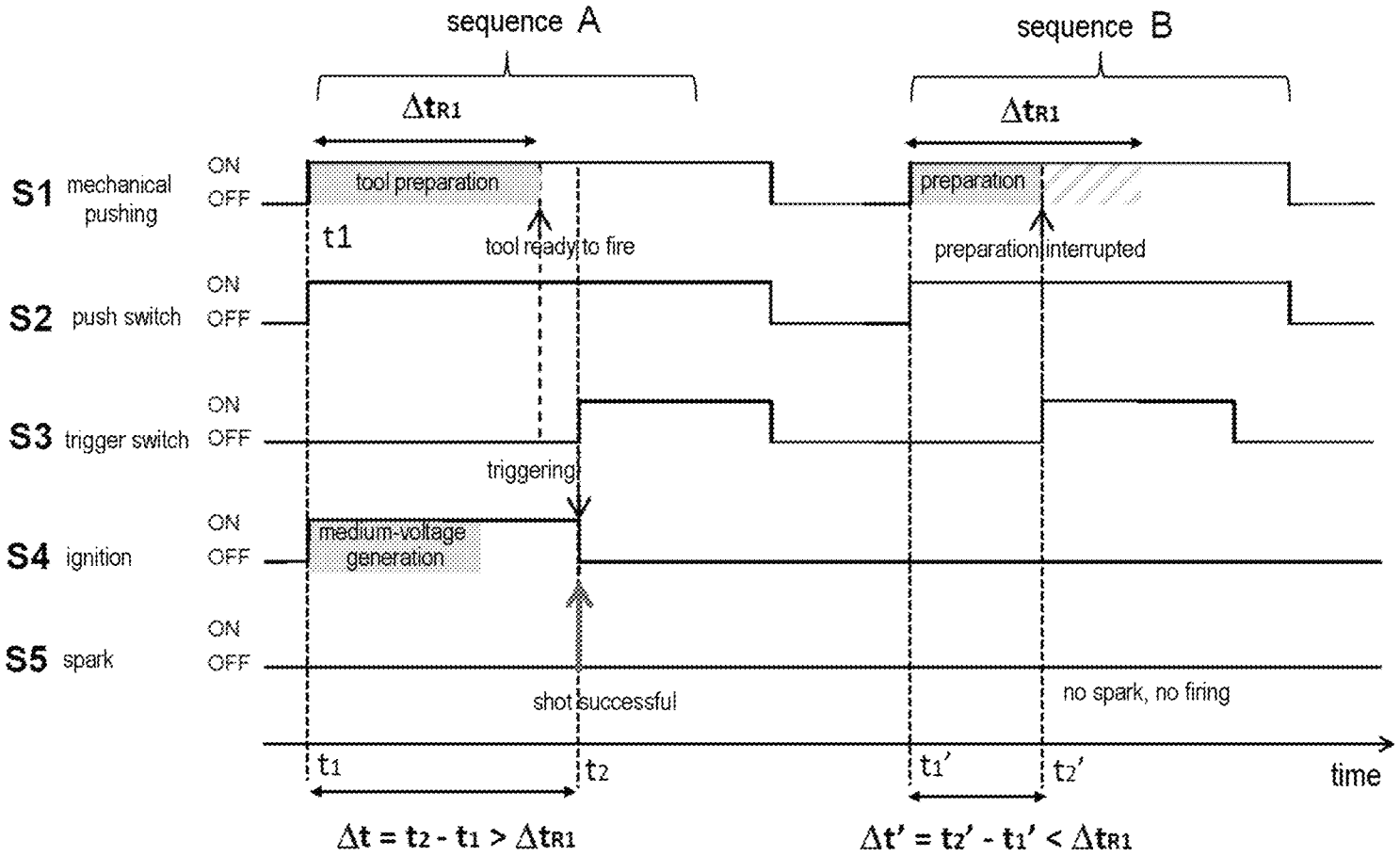
FIG. 5 is a chronogram illustrating sequences of events occurring during the use of a gas-powered fixing tool including the ignition control device implementing the timer means according to the first embodiment of the present disclosure.

The active state and the inactive state of the phases S1-S5 are designated respectively by ON and OFF in FIG. 5. The bearing with the tool against the work zone at the first instant $t_1$ marks the start of the phase of preparation of the tool, during which the combustion chamber is filled with combustible gas. At this same first instant $t_1$, the second switch is activated, causing the starting of the generation of the medium ignition voltage by the generator of medium ignition voltage and the starting of the charging of the capacitor. At the end of a filling time greater than the first threshold $\Delta t_{R1}$ from the first instant $t_1$, the combustion chamber is sufficiently filled with gas to enable a shot of good quality. At the instant $t_1 + \Delta t_{R1}$, the tool is thus ready to enable a shot under optimal conditions.

As an illustration, let us consider that the time for preparation of the tool at the end of which the combustion chamber is filled in optimal manner corresponds to the minimum filling time $\Delta t_{R1}$. However, this preparation time could be set at any other value between the first and second thresholds.

When the user pulls on the trigger 10 at the second instant $t_2$, the microcontroller 30 measures a time interval $\Delta t=t_2-t_1$ greater than the time for preparation of the tool, corresponding to the first threshold $\Delta t_{R1}$ (first condition fulfilled). At this same second instant $t_2$, let us assume that the capacitor 26 has had enough time to become charged. In this case, the voltage measured by the microcontroller is greater than the trigger threshold voltage $V_d$ (second condition fulfilled). Thus, the generation of the medium ignition voltage is finished when the user pulls on the trigger 10. The first and second conditions being fulfilled, the shot is allowed: the microcontroller 30 issues the trigger command S to the controlled trigger device 27' which induces the generating of the high-voltage signal and of the spark (sequence A).

In the event that the microcontroller measures a time interval $\Delta t'=t_2'-t_1'$ between the first instant $t_1'$ when the tool is brought to bear and the second $t_2'$ when the user pulls on the trigger which is less than the minimum time for preparation of the tool ($\Delta t_{R1}$ first threshold), the preparation of the tool is interrupted before reaching the minimum filling of the chamber with the gas (sequence B). In this case, the shot is not allowed by the microcontroller 30, which does not send any trigger command to the controlled trigger device 27'.

Figure 6:
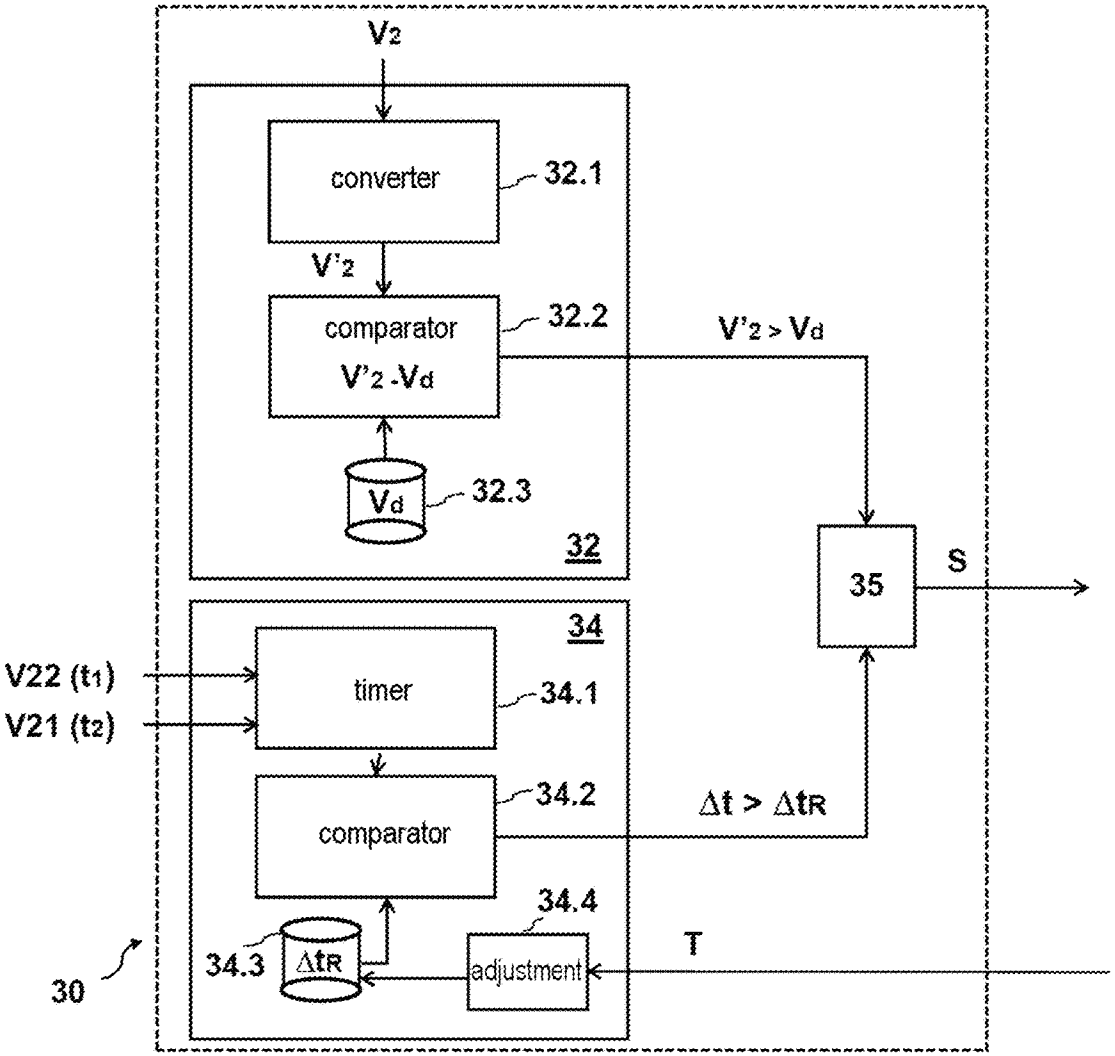
FIG. 6 is a detailed block diagram of the ignition control device of the combustion chamber according to the first embodiment of the present disclosure.

FIG. 6 is a schematic block diagram of a control device for the ignition of a combustion chamber for a gas-powered fixing tool. This control device comprises inputs/outputs to interface with:

- the first switch 21 driven by the mechanical bearing with the tool against a work surface and the receiving of the signal $V_{21}$ for detection of the mechanical bearing with the tool at the first instant $t_1$,
- the second switch 22 driven by the actuating of the trigger 10 of the tool by the user and receiving the signal $V_{22}$ for detection of the pulling on the trigger 10 at the second instant $t_2$,
- the temperature sensor 40 designed to provide an ambient working temperature parameter T,
- the charge capacitor 26, and
- the device for triggering of the ignition 27'.

This device furthermore comprises a time measurement and time comparison means 34 comprising:

- measurement means 34.1 to measure the time interval $\Delta t$ between the first instant $t_1$ and the second instant $t_2$, the first and second instants being registered by said measurement means respectively upon reception of the signal $V_{21}$ for detection of the mechanical bearing with the tool and upon reception of the signal $V_{22}$ for detection of the pulling on the trigger 10,
- comparison means 34.2 to compare the time interval $\Delta t$ measured in relation to the first threshold $\Delta t_{R1}$ and the second threshold $\Delta t_{R2}$ and provide a comparison signal S34 if the measured time interval $\Delta t$ is within the first and second thresholds,
- adjustment means 34.4 to adjust the values of the first $\Delta t_{R1}$ and second $\Delta t_{R2}$ thresholds,
- storage means 34.3 to store information about the configuration such as the values of the first $\Delta t_{R1}$ and second $\Delta t_{R2}$ thresholds, and rules for adjustment of these values as a function of at least one ambient working temperature parameter.

The device further comprises a voltage measurement and comparison means 32 comprising:

- conversion means 32.1 for converting the medium ignition voltage signal $V_2$ into an amplitude signal $V'_2$ which can be compared with the trigger threshold voltage $V_d$,
- comparison means 32.2 to compare the converted signal $V'_2$ in relation to the trigger threshold voltage $V_d$, and
- storage means 32.3 for storing configuration parameters such as the value of the trigger threshold voltage $V_d$.

This device further comprises a decision-making element 35 connected to the voltage comparison means 32.2 and to the time comparison means 34.2, the decision-making element being adapted to generate the control signal S going to the controlled trigger 27' upon reception of a signal put out by the two measurement and comparison means 32 and 34, indicating that the two conditions are fulfilled.

According to another embodiment of the present disclosure, the electronic ignition control device according to the present disclosure is designed to be disposed in a single removable block in order to carry out the steps of the method according to the present disclosure. Such an arrangement enables an easy maintenance and replacement of the block during repair and servicing operations.

According to one embodiment of the present disclosure, the measurement and comparison elements 32 and 34 and the decision-making element 35 are implemented by a microcontroller. However, the latter could be replaced by any other device designed to realize the functions described above.

Figure 7:
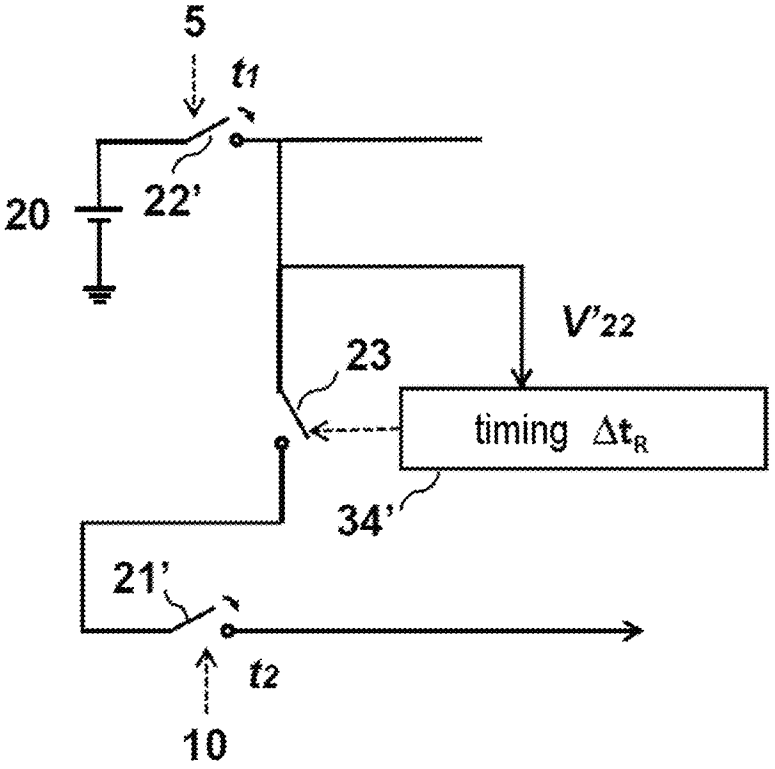
FIG. 7 illustrates the timer means and means of generation of a control signal according to a second embodiment.

According to a second embodiment as illustrated schematically in FIG. 7, the timing means are implemented by means of a timer module 34' driving a timer switch 23, mounted in series between on the one hand a push switch 22' driven by the pushing with the tool and on the other hand a trigger switch 21' driven by the pulling on the trigger 10.

The means of generation of a control signal for triggering the ignition of the combustion chamber are constituted by the timing means, the push switch, the release switch, the timer switch, and the voltage source 20.

The first means of detection for detecting the pushing with the tool against a work surface at the first instant $t_1$ (first mechanical event) are formed by the push switch 22' connected to the voltage source 20.

The second means of detection for detecting the pulling on the trigger 10 are formed by the release switch 21' mounted in series with the push switch.

The timer module 34' is adapted to trigger the running down of a delay time $\Delta t_R$, upon reception of a detection signal $V'_{22}$ furnished by the voltage source 20. This detection signal is furnished as long as the push switch 22' is closed, upon the pushing of the tool against the work surface at the first instant $t_1$ (first mechanical event).

The delay time $\Delta t_R$ is predefined in the timer module 34'. Advantageously, the value of the delay time is set in a confidence interval between the first $\Delta t_{R1}$ and second $\Delta t_{R2}$ thresholds corresponding respectively to first and second timing values, such that $\Delta t_{R1}<\Delta t_R<\Delta t_{R2}$ to ensure optimal firing conditions as described above.

According to one embodiment of the present disclosure, the value of the delay time $\Delta t_R$ can be adjusted in real time, as a function of at least one temperature parameter T, such as the ambient temperature or working temperature, this parameter being furnished as described above by the sensor 40, allowing even further improving of the firing conditions.

Figure 8:
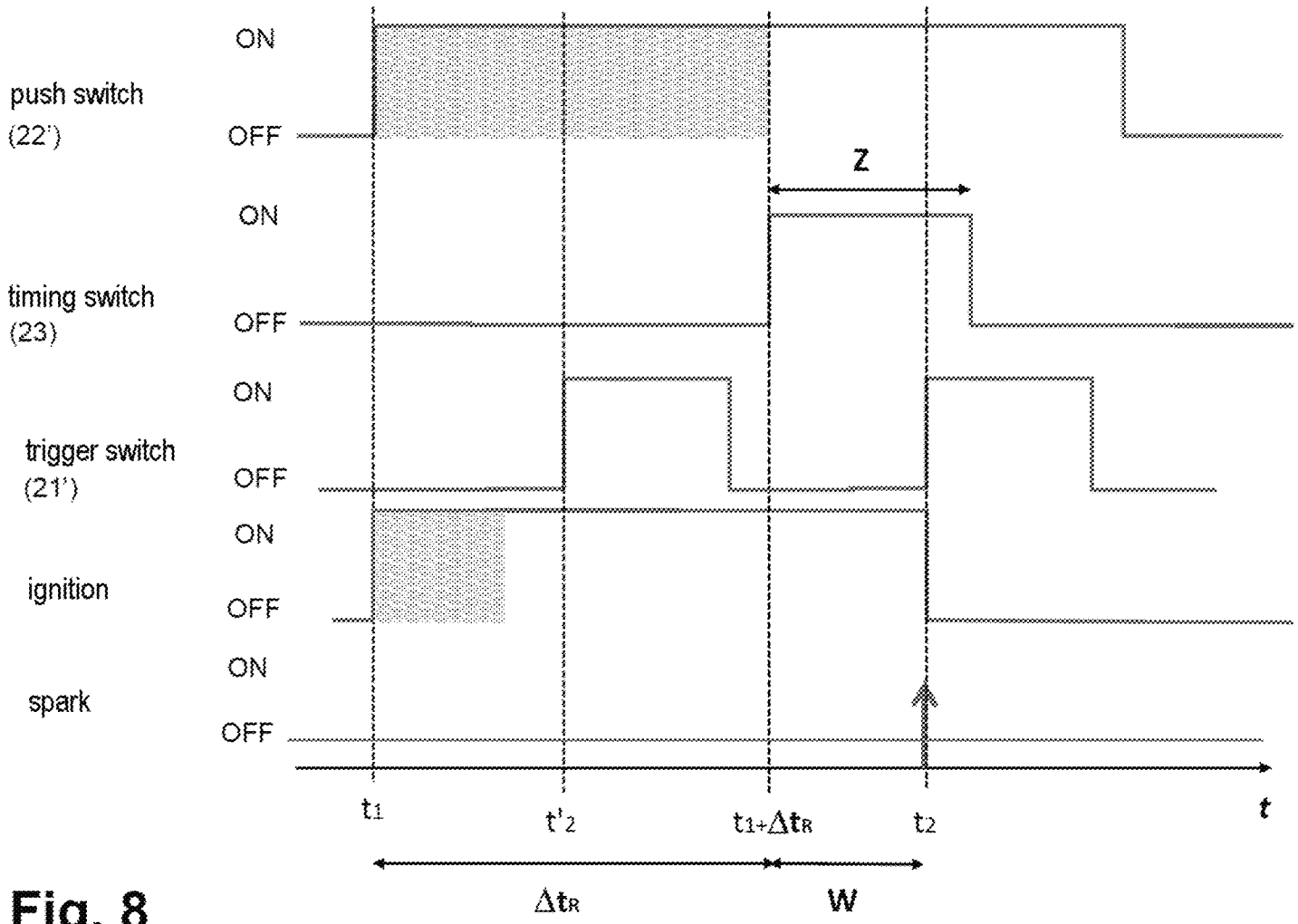
FIG. 8 is a chronogram illustrating a sequence of events occurring during the use of a gas-powered fixing tool including the ignition control device implementing the timer means according to the second embodiment.

The present disclosure shall now be described in reference to FIG. 8 which illustrates a sequence of events occurring during the use of the tool equipped with an ignition control device according to the second embodiment. For a switch, the "ON" state designates that it is closed (activated), while the "OFF" state designates that it is open.

According to one embodiment of the present disclosure, the trigger command for firing the shot of the tool cannot be generated as long as the delay time $\Delta t_R$ has not totally run out by the timer module 34', counting down from the closing of the push switch 22' at the first instant $t_1$.

After running out of the delay time, at instant $t_1+\Delta t_R$, the filling of the combustion chamber with the combustible gas is optimal. At this instant, the timer module 34' causes the closing of the timer switch 23, such that the electric signal put out by the voltage source 20 is transmitted at the output of the timer switch 23.

The pulling on the trigger 10 of the tool causes the closing of the release switch 21'.

If the pulling on the trigger occurs before the expiration of the delay time, at an instant $t'_2<t_1+\Delta t_R$, the release switch 21' is closed while the timer switch 23' remains open. In this case, the voltage signal at the output of the push switch 22' cannot be sent to the release switch. Thus, the trigger command for the shot cannot be generated until the timer module 34' closes the timer switch 23.

If the pulling on the trigger occurs after the expiration of the delay time, at an instant $t_2>t_1+\Delta t_R$, the push switch 22', the timer switch 23 and the release switch 21' are all closed ("ON" state), so that the electric signal put out by the voltage source 20 is furnished at the output of the release switch 21'. The trigger command for firing the shot can then be generated.

In this case, it will be noted that the triggering of the shot is not done directly upon the expiration of the delay time at the instant $t_1+\Delta t_R$ but rather at the end of a period of time W from the instant $t_1+\Delta t_R$ at the moment of pulling on the trigger at the instant $t_2$.

According to one embodiment of the present disclosure, one could prevent the triggering of the shot if this period of time W exceeds a certain threshold value, beyond which the conditions for filling of the combustion chamber are no longer optimal to guarantee a good quality shot.

In this case, the timer module 34' is adapted to trigger another countdown as of the instant $(t_1+\Delta t_R)$ when it produces the closing of the timer switch, so that the shot is no longer possible at the end of a period $W_{max}$, such that $t_2-t_1=W_{max}+\Delta t_R\leq\Delta t_{R2}$.

According to one embodiment of the present disclosure, the timer switch 23 moves from the closed ON state to the open OFF state at the end of a time Z, to enable the next firing. The toggling from the closed state to the open state of the timer switch 23 can be driven by the timer module 34', or by again pulling on the trigger 10 of the tool, after the sending of a trigger command for the shot.

As described above in reference to FIGS. 3-6, the trigger command going to the controlled trigger device 27' can be generated on the supplemental condition that the medium ignition voltage is greater than the reference trigger voltage $V_d$. The verification of this condition is done by means of the voltage comparator 32 or any other equivalent device.

The invention claimed is:

1. A method for controlling electronic ignition of a gas-powered fastener-driving tool, the method comprising:

detecting a first mechanical event at a first point in time;

detecting a second mechanical event at a second point in time; and after detecting the second mechanical event, if a time elapsed between the first and second points in time exceeds a first predetermined time period, generating a control signal to trigger ignition of a fuel/air mixture.

2. The method of claim 1, which includes measuring the time elapsed between the first and second points in time and comparing the time elapsed between the first and second points in time to the first predetermined time period.

3. The method of claim 1, which includes triggering a timeout timer having an initial value equal to the first predetermined time period responsive to detecting the first mechanical event and generating the control signal if the detection of the second event occurs after the timeout timer times out.

4. The method of claim 1, which includes generating the control signal if the time elapsed between the first and second points in time both: (1) exceeds the first predetermined time period; and (2) is less than a second predetermined time period.

5. The method of claim 4, which includes adjusting at least one of the first and second predetermined time periods based on a measured temperature parameter.

6. The method of claim 1, which includes:

generating a medium ignition voltage initiated responsive to detecting the first mechanical event;

comparing the medium ignition voltage to a reference trigger voltage; and generating the control signal if both: (1) the time elapsed between the first and second points in time exceeds the first predetermined time period; and (2) the medium ignition voltage has an amplitude that exceeds the reference trigger voltage.

7. The method of claim 6, which includes, between generating the medium ignition voltage and comparing the medium ignition voltage to the reference trigger voltage, converting the medium ignition voltage into a voltage comparable to the reference trigger voltage.

8. The method of claim 6, which includes generating the medium ignition voltage before detecting the second mechanical event.

9. The method of claim 1, wherein detecting the first mechanical event includes detecting closure of a first switch responsive to depression of a guide tip of the tool, wherein detecting the second mechanical event includes detecting closure of a second switch responsive to an actuation of a trigger of the tool, and wherein generating the control signal includes generating the control signal by a controller.

10. A device for controlling electronic ignition of a gas-powered fixing tool, the device comprising:

a first detector configured to detect a first mechanical event associated with the tool;

a second detector configured to detect a second mechanical event associated with the tool; and a controller operably connected to the first and second detectors and configured to, if a time elapsed between detection of the first mechanical event and detection of the second mechanical event exceeds a first predetermined time period, generate a control signal to trigger ignition of a fuel/air mixture.

11. The device of claim 10, wherein the controller is configured to measure the time elapsed between the detection of the first mechanical event and the detection of the second mechanical event and compare the time elapsed between the detection of the first mechanical event and the detection of the second mechanical event to the first predetermined time period.

12. The device of claim 10, wherein the first detector includes a first switch operably connectable to a first mechanical device of the tool, wherein the second detector includes a second switch operably connectable to a second mechanical device of the tool, and the first and second switches are connected to the controller.

13. The device of claim 10, wherein the controller is configured to trigger a timeout timer having a value equal to the first predetermined time period responsive to detecting the first mechanical event and to generate the control signal if the detection of the second event occurs after the timer times out.

14. The device of claim 13, wherein the first detector includes a first switch operably connectable to a first mechanical device of the tool, wherein the second detector includes a second switch operably connectable to a second mechanical device of the tool, and wherein the controller includes a timer module coupled to a timer switch mounted in series between the first and second switches.

15. The device of claim 10, wherein the controller is configured to generate the control signal if the time elapsed between detection of the first mechanical event and detection of the second mechanical event both: (1) exceeds the first predetermined time period; and (2) is less than a second predetermined time period.

16. The device of claim 15, wherein the controller is configured to adjust at least one of the first and second predetermined time periods based on a measured temperature parameter.

17. The device of claim 10, which includes a voltage generator configured to generate a medium ignition voltage responsive to detection of the first mechanical event, wherein the controller is configured to compare the medium ignition voltage to a reference trigger voltage and to generate the control signal if both: (1) the time elapsed between detection of the first mechanical event and detection of the second mechanical event exceeds the first predetermined time period; and (2) an amplitude of the medium ignition voltage is greater than the reference trigger voltage.

18. The device of claim 17, wherein the controller is configured to convert said medium ignition voltage into a voltage comparable to the reference trigger voltage.

19. The device of claim 17, wherein the controller is configured to generate the medium ignition voltage before detection of the second mechanical event.

20. A gas-powered fastener-driving tool comprising:

a first mechanical component;

a first detector operably connected to the first mechanical component to detect actuation of the first mechanical component;

a second mechanical component;

a second detector operably connected to the second mechanical component to detect actuation of the second mechanical component; and a controller operably connected to the first and second detectors and configured to, if a time elapsed between detection of the first mechanical event and detection of the second mechanical event exceeds a first predetermined time period, generate a control signal to trigger ignition of a fuel/air mixture.

* * * * *